US007726644B2

(12) United States Patent
Isohara et al.

(10) Patent No.: US 7,726,644 B2
(45) Date of Patent: Jun. 1, 2010

(54) PAPER SHEET CONVEYANCE APPARATUS AND IMAGE FORMING APPARATUS

(75) Inventors: Hideo Isohara, Hachioji (JP); Tetsu Sekine, Sagamihara (JP); Yoshiki Katayama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 270 days.

(21) Appl. No.: 11/823,907

(22) Filed: Jun. 29, 2007

(65) Prior Publication Data

US 2008/0018046 A1 Jan. 24, 2008

(30) Foreign Application Priority Data

Jul. 21, 2006 (JP) ..... 2006-199175

(51) Int. Cl.
*B65H 29/66* (2006.01)

(52) U.S. Cl. ..... 271/65; 271/186

(58) Field of Classification Search ..... 271/186, 271/291, 301, 65, 109, 314
See application file for complete search history.

(56) References Cited

U.S. PATENT DOCUMENTS

2005/0100370 A1* 5/2005 Van Den Berg et al. ..... 399/309
2006/0133871 A1* 6/2006 Ishida ..... 399/341

FOREIGN PATENT DOCUMENTS

JP 2005-350245 A 12/2005

* cited by examiner

*Primary Examiner*—Patrick Mackey
*Assistant Examiner*—Michael C McCullough
(74) *Attorney, Agent, or Firm*—Frishauf, Holtz, Goodman & Chick, P.C.

(57) ABSTRACT

There is described a paper sheet conveyance apparatus and an image forming apparatus, which makes it possible not only to achieve the minimization and the cost reduction of the apparatus; but also to achieve the high-speed conveyance operation of the paper sheet without generating any step out of the stepping motor. The paper sheet conveyance apparatus, includes: a pair of conveyance rollers to convey a paper sheet; and a stepping motor to drive one of the pair of conveyance rollers. At least one of the conveyance rollers is a roller made of aluminum alloy metal. Further, the roller made of the aluminum alloy metal is shaped in a hallow cylinder. Still further, a surface hardening treatment is applied to a circumferential surface of the roller made of the aluminum alloy metal.

10 Claims, 2 Drawing Sheets

PAPER SHEET CONVEYANCE APPARATUS AND IMAGE FORMING APPARATUS

This application is based on Japanese Patent Application No. 2006-199175 filed on Jul. 21, 2006 with Japan Patent Office, the entire content of which is hereby incorporated by reference.

BACKGROUND OF THE INVENTION

The present invention relates to a paper sheet conveyance apparatus and an image forming apparatus provided with the paper sheet conveyance apparatus, and specifically, relates to a paper sheet conveyance apparatus that can convey a paper sheet at a controlled timing and/or in a reversible conveyance mode in which the conveyance direction of the paper sheet is switched from a normal direction to a reverse direction or vise versa and/or in a variable speed conveyance mode, and an image forming apparatus provided with such the paper sheet conveyance apparatus mentioned in the above.

Conventionally, a stepping motor has been widely employed as a driving source of the conveyance mechanism for conveying the paper sheet.

For instance, Patent Document 1 (Tokkai 2005-350245, Japanese Non-Examined Patent Publication) sets forth a stepping motor that is employed as a driving source of the conveyance mechanism installed at the paper sheet re-feeding section of the duplex image forming apparatus, in which an obverse side of paper sheet, having an image already formed on it, is turned to its reverse side, so as to feed the paper sheet again into the image forming section.

It is desirable that the motor for driving the conveyance mechanism is as small as possible, in order to minimize the space occupied by the motor, and further, to reduce its cost.

On the other hand, it is also desirable that a pair of rollers to be configured into the conveyance mechanism has such a sufficient stiffness that an unevenness of the nip portion formed between the rollers does not occur due to the deformation of the rollers. In addition, it is still desirable that the outer diameter of each roller is as great as possible, since it is necessary that the paper sheet should smoothly enter into the nip portion of the pair of rollers.

Generally speaking, since a rated output power of a small-sized stepping motor is relatively small, the step out is liable to occur at its startup time, at a reversing moment of its rotational direction, or at a velocity changing time for its accelerating or decelerating operation Further, on the other hand, the larger an outer diameter of a roller included in the pair of rollers is made, the larger a load for the driving source becomes, due to increase of the mass of the roller, resulting in an increase of the step out frequency of the stepping motor.

Accordingly, since the sufficient stiffness and the accuracy is necessary for the pair of rollers to be configured into the conveyance mechanism as mentioned in the above, conventionally, the roller made of stainless metal, such as a stainless steel roller on which the paper sheet conveyance surface is directly formed as a stainless surface or a rubber-coated stainless steel roller in which a rubber layer is formed on a shaft member made of the stainless steel, is employed as such the roller.

However, in order to achieve a further minimization and a cost reduction of the apparatus, and to achieve an improvement of the efficiency of the image forming apparatus, etc., by increasing the conveyance velocity of paper sheet, it has been quite difficult to fulfill the abovementioned conditions when employing the conventional pair of rollers made of stainless metal. Accordingly, the prevention of step out has been the subject to be solved.

SUMMARY OF THE INVENTION

To overcome the abovementioned drawbacks in conventional paper sheet conveyance apparatus and image forming apparatus, it is one of objects of the present invention to provide a paper sheet conveyance apparatus and an image forming apparatus, which makes it possible not only to achieve a minimization and a cost reduction of the apparatus, but also to achieve a high-speed conveyance operation of the paper sheet without generating any step out of the stepping motor.

Accordingly, at least one of objects of the present invention can be attained by the paper sheet conveyance apparatus, the image forming apparatus and the duplex image forming apparatus described as follows.

(1) According to a paper sheet conveyance apparatus reflecting an aspect of the present invention, the paper sheet conveyance apparatus comprises: a pair of conveyance rollers to convey a paper sheet; and a stepping motor to drive one of the pair of conveyance rollers; wherein at least one of the conveyance rollers is a roller made of aluminum alloy metal.

(2) According to an image forming apparatus reflecting another aspect of the present invention, the image forming apparatus comprises: an image forming section to form an image on a paper sheet; and a paper sheet conveyance section to convey the paper sheet into/from the image forming section; wherein the paper sheet conveyance section includes: a pair of conveyance rollers to convey the paper sheet; and a stepping motor to drive one of the pair of conveyance rollers; and wherein at least one of the conveyance rollers is a roller made of aluminum alloy metal.

(3) According to a duplex image forming apparatus reflecting still another aspect of the present invention, the duplex image forming apparatus comprises: an image forming section to form a first image and a second image on an obverse surface and a reverse surface of a paper sheet, respectively; and a paper sheet re-feeding section that turns the obverse surface of the paper sheet, on which the first image is already formed by the image forming section, to the reverse surface, and then, feeds the paper sheet again into the image forming section, so that the image forming section can form the second image on the reverse surface of the paper sheet; wherein the paper sheet re-feeding section includes: a pair of conveyance rollers to convey the paper sheet; and a stepping motor to drive the pair of conveyance rollers; and wherein at least one of the conveyance rollers is a roller made of aluminum alloy metal.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
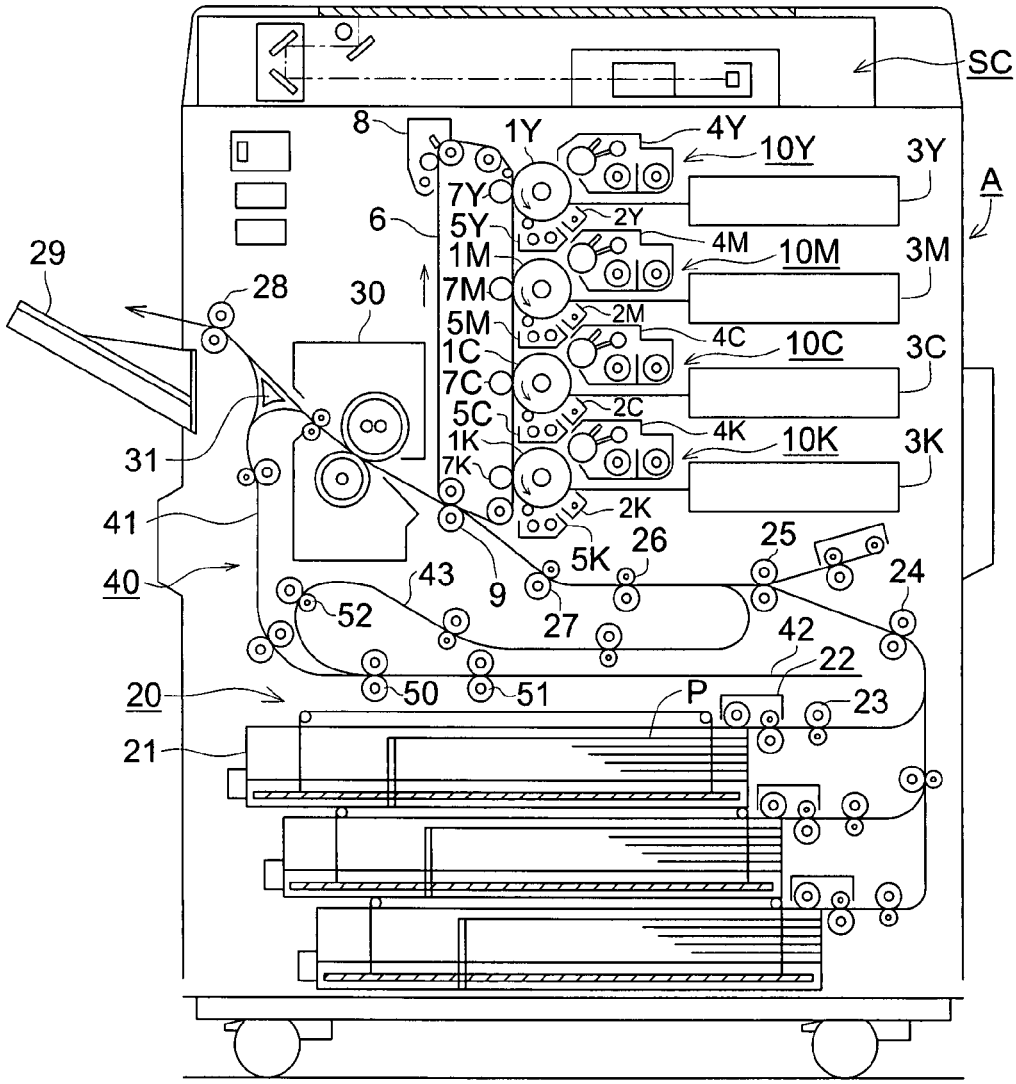
FIG. 1 shows a schematic diagram of an overall configuration of an image forming apparatus embodied in the present invention.

Referring to the drawings, the image forming apparatus embodied in the present invention will be detailed in the following. However, the scope of the present invention is not limited to the embodiment described as follows.

FIG. 1 shows a schematic diagram of an overall configuration of the image forming apparatus embodied in the present invention.

The image forming apparatus shown in FIG. 1 is called a tandem color image forming apparatus, and is constituted by an image forming section provided with a plurality of image forming units 10Y, 10M, 10C, 10K, a belt-type intermediate transfer member 6 and a secondary transferring unit 9, a paper sheet feeding section 20 and a fixing section 30.

An image reading apparatus SC is installed on the upper side of the image forming apparatus. An optical system of the document-image scanning device equipped in the image reading apparatus SC exposes an image residing on the document placed on a document plate by scanning light, so that a line image sensor reads the image. The analogue signals, generated by the photoelectronic converting actions performed in the line image sensor, are processed by applying various kinds of processing, such as an analogue processing, an analogue-to-digital conversion processing, a shading correction processing, an image compression processing, etc., in the image processing section, and then, processed image data are inputted into light writing devices 3Y, 3M, 3C, 3K (hereinafter, also referred to as exposing devices 3Y, 3M, 3C, 3K).

The image forming section 10Y for forming a toner image of color Y (Yellow) includes a photoreceptor drum 1Y serving as an image bearing member, and further includes a charging device 2Y, an exposing device 3Y, a developing device 4Y and a cleaning unit 5Y, all of which are disposed at respective positions in the peripheral space around the circumferential surface of the photoreceptor drum 1Y. Further, the image forming section 10M for forming a toner image of color M (Magenta) includes a photoreceptor drum 1M serving as an image bearing member, and further includes a charging device 2M, an exposing device 3M, a developing device 4M and a cleaning device 5M, all of which are disposed at respective positions in the peripheral space around the circumferential surface of the photoreceptor drum 1M. Still further, the image forming section 10C for forming a toner image of color C (Cyan) includes a photoreceptor drum 1C serving as an image bearing member, and further includes a charging device 2C, an exposing device 3C, a developing device 4C and a cleaning device 5C, all of which are disposed at respective positions in the peripheral space around the circumferential surface of the photoreceptor drum 1C. Yet further, the image forming section 10K for forming a toner image of color K (Black) includes a photoreceptor drum 1K serving as an image bearing member, and further includes a charging device 2K, an exposing device 3K, a developing device 4K and a cleaning device 6K, all of which are disposed at respective positions in the peripheral space around the circumferential surface of the photoreceptor drum 1Y.

Each pair of the charging device 2Y and the exposing device 3Y, the charging device 2M and the exposing device 3M, the charging device 2C and the exposing device 3C, and the charging device 2K and the exposing device 3K, constitutes a latent image forming section.

Further, each of the developing devices 4Y, 4M, 4C, 4K accommodates two component developer including fine particle toner of the corresponding one of colors Y (Yellow), M (Magenta), C (Cyan), K (Black), and carrier in it.

The belt-type intermediate transfer member 6 is threaded on a plurality of rollers and rotatably supported by them so as to circulate around them.

The toner images of color Y, color M, color C and color K, formed on the photoreceptor drums 1Y, 1M, 1C, 1K by the plurality of image forming units 10Y, 10M, 10C, 10K, respectively, are sequentially transferred onto the intermediate transfer member 70 in such a manner that the toner images of color Y, color M, color C and color K are superimposed with each other so as to form a full color toner image on the belt-type intermediate transfer member 6.

A paper sheet P accommodated in a paper sheet feeding cassette 21 of the paper sheet feeding section 20 is picked up by a paper sheet pickup device 22 (first paper sheet feeding section), and successively, conveyed to the secondary transferring unit 9 by pairs of paper sheet feeding rollers 23, 24, 25, 26 and a pair of registration rollers 27, etc., so as to transfer the full color toner image onto the paper sheet P from the belt-type intermediate transfer member 6.

In this connection, the structures of the paper sheet feeding cassettes 21 included in the three-stage configuration of the paper sheet feeding section 20 are substantially the same as each other. Further, the structures of the paper sheet pickup devices 22 included in the three-stage configuration of the paper sheet feeding section 20 are substantially the same as each other. Hereinafter, the paper sheet feeding section 20 includes the paper sheet feeding cassette 21 and the paper sheet pickup device 22.

Successively, the paper sheet P, on which the full color toner image is transferred, is tightly clipped by a pair of fixing rollers in the fixing section 30 so as to fix the full color toner image onto the paper sheet P by applying heat and pressure onto the paper sheet P. Then, the paper sheet P, having the fixed color image on it, is tightly clipped by a pair of ejecting rollers 28 so as to eject and place it onto an ejecting tray 29 disposed outside the apparatus.

On the other hand, after the full color toner image is transferred onto the paper sheet P, and then, the paper sheet P is separated form the belt-type intermediate transfer member 6 by the curvature separating action, the residual toner remaining on the belt-type intermediate transfer member 6 are removed by a cleaning section 8.

Numeral 40 indicates a paper sheet re-feeding section to re-feed the paper sheet P, on an obverse surface of which the image is already formed, into the secondary transferring unit 9 through the pair of registration rollers 27. The paper sheet re-feeding section 40 includes a branch conveyance path 41 branched from the conveyance path toward the pair of ejecting rollers 28, a reversing conveyance path 42 to turn the obverse surface of the paper sheet P to its reverse side and a re-feeding conveyance path 43 to re-feed the paper sheet P toward the pair of registration rollers 27.

A switching gate 31 is provided for switching the conveying direction of the paper sheet P passed through the fixing section 30, namely, for selecting whether conveying it to the pair of ejecting rollers 28 or the paper sheet re-feeding section 40.

Further, plural pairs of conveyance rollers are equipped in the paper sheet re-feeding section 40, and pairs of conveyance rollers 50, 51, which rotate in both normal and reverse directions, are provided in the reversing conveyance path 42.

Figure 2:
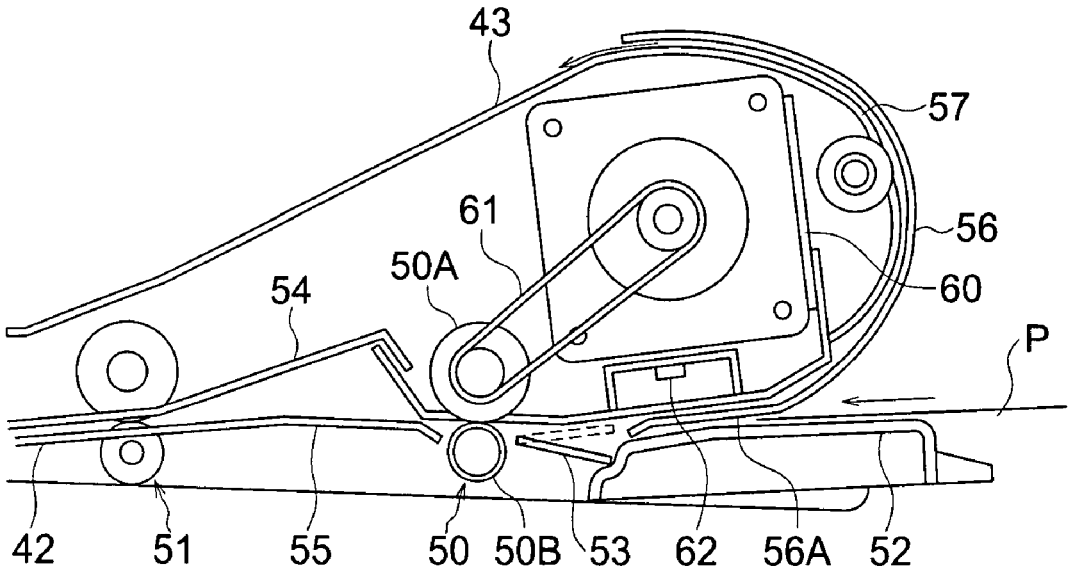
FIG. 2 shows a schematic diagram of a main section of a paper sheet re-feeding section.

FIG. 2 shows a schematic diagram of a main section of the paper sheet re-feeding section 40.

Since the schematic diagram shown in FIG. 2 is a view viewing from the position at which a stepping motor 60 is disposed, and in other words, viewing from the reverse side of the paper sheet on which FIG. 1 is depicted, the layout relationships of the depicted parts, such as the positions of the pairs of conveyance rollers 50, 51, etc., between FIG. 1 and FIG. 2 are reversed to each other.

The reversing conveyance path 42 shown in FIG. 1 is formed by a pair of guide plates 54, 55, while the re-feeding conveyance path 43 is formed by a pair of guide plates 56, 57.

The pair of conveyance rollers 50 includes a driving roller 50A and a driven roller 50B. The driving roller 50A is structured by forming a rubber layer on a stainless steel roller, while the driven roller 50B is a roller made of aluminum alloy metal and is shaped in a hollow cylinder of the aluminum alloy metal. Further, the stepping motor 60 drives the driving roller 50A through a driving belt 61.

Although the pair of conveyance rollers 51 conveys the paper sheet P according to substantially the same action as that of the pair of conveyance rollers 50 as detailed later, another motor (not shown in the drawings), other than the stepping motor 60, drives the pair of conveyance rollers 51. As shown in FIG. 2, the pair of guide plates 54, 55 is formed in such a manner that a space between the guide plate 54 and the guide plate 55 disposed at the entrance section of the reversing conveyance path 42 is wider than that of another section of the same conveyance path, so that the paper sheet P can be shaped in a loop within the space concerned.

Numeral 62 indicates a paper sheet passing sensor to detect the paper sheet P passing through it.

A guide plate 53 is rotatably mounted by making its left end portion a fulcrum, so as to be rotatable from a position indicated by the solid lines to another position indicated by the doted lines as detailed later.

When the paper sheet P is to be conveyed to the paper sheet re-feeding section 40, the guide plate 53 is positioned at the position indicated by the solid lines by its own weight, and the pairs of conveyance rollers 50, 51 rotate so as to convey the paper sheet P to the reversing conveyance path 42.

The paper sheet P fed from a branch conveyance path 41 shown in FIG. 1 passes through a space formed between a guide plate 52 and a lower guide plate 56A being a lower potion of a guide plate 56, and then, passes on the upper side of the guide plate 53, and still then, enters into the nip portion formed between the driving roller 50A and the driven roller 50B, so that the pairs of conveyance rollers 50, 51 nips the paper sheet P to convey it in the left direction shown in FIG. 2.

Although rotating actions of the pairs of conveyance rollers 50, 51 are deactivated in response to a paper-sheet leading edge detected signal outputted from the paper sheet passing sensor 62 to stop the conveyance operation of the paper sheet P, the timing of deactivating the rotating action of the pair of conveyance rollers 51 is slightly delayed from that of the pair of conveyance rollers 50. Accordingly, the loop of the paper sheet P is formed in the space located at the left side of the pair of conveyance rollers 51, so as to achieve a posture control of the paper sheet P.

At the time when a predetermined time period established in advance by a timer (not shown in the drawings) has elapsed since the paper sheet passing sensor 62 detected the leading edge of the paper sheet P, and when the right edge of the paper sheet P arrives at a position between the pairs of conveyance rollers 50, 51, the rotating directions of the stepping motor 60 and the motor (not shown in the drawings) are reversed, so that the pairs of conveyance rollers 50, 51 reverse the conveyance direction of the paper sheet P, so as to convey it in a right direction shown in FIG. 2. At the time when the paper sheet P is conveyed in the reverse direction, a solenoid (not shown in the drawings) drives the guide plate 53 so as to rotate it to the position indicated by the dotted lines. Then, the paper sheet P is conveyed into the re-feeding conveyance path 43 formed by the guide plate 56 and a guide plate 57.

Although the pair of conveyance rollers 50 conveys the paper sheet P while reversing its rotating direction as mentioned in the foregoing, sometimes in such the reversible conveyance operation, the stepping motor 60 would step out, due to the relationship between the torque and the load.

It is necessary for the stepping motor 60 to be as small as possible, due to such the conditions that it is desirable that the apparatus should be minimized and low-cost.

On the other hand, it is desirable for the pairs of conveyance rollers 50, 51 to make the outer diameter of each of the constituent rollers as large as possible, due to a condition that the paper sheet P should be smoothly introduced into the nip portion formed between the driving roller 50A and the driven roller 50B, and due to another condition that distortion in an axis direction or unevenness of the nip pressure caused by a bending deformation should be suppressed.

As a result of minimizing the stepping motor 60, its output torque also becomes small. On the other hand, as a result of increasing the outer diameter, inertia of the constituent roller also becomes large. This results in frequent occurrences of the step out of the stepping motor 60, namely, the step out is liable to easily occur.

According to the present embodiment described in the foregoing, since the roller made of aluminum alloy metal, namely, the hollow cylindrical member made of aluminum alloy metal, is employed for the driven roller 50B, it becomes possible to fulfill such the reciprocal conditions as mentioned in the above.

Since the aluminum alloy metal is lightweight and has a relatively high stiffness, it becomes possible to increase the outer diameter of the roller, while suppressing inertia of the roller.

Further, any kind of aluminum alloy metal materials well known in the conventional market could be employed for this purpose.

Although the hollow cylindrical roller is employed as the driven roller 50B in the present embodiment mentioned in the above, it is also applicable that a solid column-shaped roller is employed for this purpose, instead of the hollow cylinder. Since the aluminum alloy metal is inherently lightweight regardless hollow or not, it is possible to sufficiently reduce the inertia of the roller. In this connection, the roller made of aluminum alloy metal and shaped in the hollow cylinder is more preferable.

Further, in order to increase the surface hardness of the roller, it is desirable that a surface hardening treatment, such as nickel plating, an alumite processing, etc., is applied onto the roller concerned.

Still further, other than the roller made of aluminum alloy metal, the outer surface of which directly serves as the paper sheet conveying surface, as shown in the drawings of the present embodiment, a roller having a rubber layer formed on a core roller made of aluminum alloy metal, so that the rubber layer serves as the paper sheet conveying surface, is also applicable as the aluminum alloy metal roller embodied in the present invention.

Still further, although the roller made of aluminum alloy metal is employed for the driven roller 50B constituting the pair of conveyance rollers 50 in the present embodiment described in the foregoing, it is also applicable that the roller made of aluminum alloy metal is employed for the driving roller 50A. By employing the roller made of aluminum alloy metal for at least one of the driving roller and the driven roller, it becomes possible not only to drastically reduce the load to be incurred by the stepping motor, but also to reduce the inertia generated at the time of the reversing operation.

Still further, it is also applicable that the roller made of aluminum alloy metal is employed for the pair of conveyance rollers 51 as well as the pair of conveyance rollers 50.

Yet further, although the roller made of aluminum alloy metal is employed for the normal/reverse rotating roller in the reverse conveyance section for conducting the switchback conveying operation of the paper sheet, by employing the roller made of aluminum alloy metal for the accelerating/decelerating conveyance roller, instead of the normal/reverse rotating roller, it becomes possible to prevent the step out, which possibly occurs at the time of the accelerating or the decelerating operation.

Incidentally, although the color image forming apparatus is exemplified for explaining the embodiment of the present invention in the foregoing, it is needless to say that the scope of the present invention also includes a monochrome image forming apparatus for forming a monochromatic image only.

Further, although the embodiment shown in the drawings is the image forming apparatus, the paper sheet conveyance apparatus embodied in the present invention can be also employed in an automatic document feeder, a paper-sheet post processing apparatus, etc.

According to these embodiments, since a roller made of aluminum alloy metal is employed for at least one of the conveyance rollers, constituting the pair of conveyance rollers to be driven by the stepping motor, the mass of the roller for conveying the paper sheet can be drastically reduced while maintaining a sufficient stiffness. As a result, it becomes possible not only to achieve the minimization and the cost reduction of the apparatus, but also to achieve the high-speed conveyance operation of the paper sheet without generating any step out of the stepping motor.

While the preferred embodiments of the present invention have been described using specific term, such description is for illustrative purpose only, and it is to be understood that changes and variations may be made without departing from the spirit and scope of the appended claims.

What is claimed is:

1. A paper sheet conveyance apparatus, installed in a paper sheet re-feeding section of a duplex image forming apparatus so as to re-feed a paper sheet into an image forming section of the duplex image forming apparatus, comprising:

a pair of conveyance rollers to convey the paper sheet; and a stepping motor to drive one of the pair of conveyance rollers;

wherein at least one of the conveyance rollers is a roller made of aluminum alloy metal; and wherein the stepping motor is operable to rotate the conveyance rollers in both a normal direction and a reverse direction so that the pair of conveyance rollers is operable to convey the paper sheet in both a forward direction and a backward direction.

2. The paper sheet conveyance apparatus of claim 1, wherein the stepping motor drives one of the pair of conveyance rollers so as to change angular velocity of one of the conveyance rollers.

3. The paper sheet conveyance apparatus of claim 1, wherein the roller made of the aluminum alloy metal is shaped in a hollow cylinder.

4. The paper sheet conveyance apparatus of claim 1, wherein a surface hardening treatment is applied to a circumferential surface of the roller made of the aluminum alloy metal.

5. The paper sheet conveyance apparatus of claim 1, wherein at least one of the conveyance rollers includes a rubber layer formed on the roller made of the aluminum alloy metal.

6. A duplex image forming apparatus, comprising:

an image forming section to form a first image and a second image on an obverse surface and a reverse surface of a paper sheet, respectively; and a paper sheet re-feeding section that turns the obverse surface of the paper sheet, on which the first image is already formed by the image forming section, to the reverse surface, and then, feeds the paper sheet again into the image forming section, so that the image forming section can form the second image on the reverse surface of the paper sheet;

wherein the paper sheet re-feeding section includes:

a pair of conveyance rollers to convey the paper sheet; and a stepping motor to drive one of the pair of conveyance rollers; and wherein at least one of the conveyance rollers is a roller made of aluminum alloy metal; and wherein the stepping motor is operable to rotate the conveyance rollers in both a normal direction and a reverse direction so that the pair of conveyance rollers are operable to convey the paper sheet in both a forward direction and a backward direction.

7. The duplex image forming apparatus of claim 6, wherein the stepping motor drives one of the pair of conveyance rollers so as to change angular velocity of one of the conveyance rollers.

8. The duplex image forming apparatus of claim 6, wherein the roller made of the aluminum alloy metal is shaped in a hollow cylinder.

9. The duplex image forming apparatus of claim 6, wherein a surface hardening treatment is applied to a circumferential surface of the roller made of the aluminum alloy metal.

10. The duplex image forming apparatus of claim 6, wherein at least one of the conveyance rollers includes a rubber layer formed on the roller made of the aluminum alloy metal.

* * * * *